United States Patent [19]

Tölle

[11] Patent Number: 4,979,263

[45] Date of Patent: Dec. 25, 1990

[54] SWIVEL BEARING FOR A DOOR-HOLDING ROD OF A DOOR HOLDER OF A MOTOR VEHICLE

[75] Inventor: Karl-Heinz Tölle, Wuppertal, Fed. Rep. of Germany

[73] Assignee: ED. Scharwachter GmbH & Co. KG

[21] Appl. No.: 349,585

[22] Filed: May 9, 1989

[30] Foreign Application Priority Data

May 9, 1988 [DE] Fed. Rep. of Germany ..... 3815795

[51] Int. Cl.[5] ..... E05D 7/10; E05D 5/12

[52] U.S. Cl. ..... 16/262; 16/82; 16/381

[58] Field of Search ..... 16/82, 262, 381, 386

[56] References Cited

U.S. PATENT DOCUMENTS

| | | | |
|---|---|---|---|
| 202,958 | 4/1878 | Patterson | 16/262 |
| 365,232 | 6/1887 | Bingham | 16/381 |
| 1,596,470 | 8/1926 | Way et al. | 16/381 |
| 1,850,229 | 3/1932 | Eastman | 16/82 |

FOREIGN PATENT DOCUMENTS

| | | | |
|---|---|---|---|
| 1448680 | 9/1976 | United Kingdom | 16/82 |

*Primary Examiner*—Richard K. Seidel
*Assistant Examiner*—Carmine Cuda
*Attorney, Agent, or Firm*—Toren, McGeady & Associates

[57] ABSTRACT

A swivel bearing for a door-holding rod of a door holder of a motor vehicle. The door-holding rod is swivelable by means of a hinge pin about an axis extending parallel to the hinge axis of the motor vehicle door. The door-holding rod extends through a holder housing arranged on another structural door component. The hinge pin is of solid material and is rigidly but releasably connected to an end of the door-holding rod. The hinge pin has axially extending portions which have a different diameter from the diameter of the middle portion of the hinge pin extending through the door-holding rod. The axial portions having the different diameter are in engagement with a running fit in two bearing openings of the bearing block which are arranged at a distance from each other.

9 Claims, 2 Drawing Sheets

SWIVEL BEARING FOR A DOOR-HOLDING ROD OF A DOOR HOLDER OF A MOTOR VEHICLE

BACKGROUND OF THE INVENTION

1. Field of the Invention

The present invention relates to a swivel bearing for the door-holding rod of a door holder of a motor vehicle. More particularly, the invention relates to a door holder with a door-holding rod whose one end is supported in a bearing block mounted on a structural door component, door or door column. The door-holding rod is swivelable by means of a hinge pin about an axis extending parallel to the hinge axis of the motor vehicle door. The door-holding rod extends through a holder housing arranged on another structural door component. The holder housing includes braking or holding members which are movable against a spring load perpendicularly to the plane of movement of the door-holding rod. The door-holding rod includes at its free end a limit stop formed by a projection and braking or locking ramps or slopes arranged in front of the limit stop, particularly in the form of bulges or increased thickness portions or the like directed transversely of the plane of movement of the door-holding rod.

2. Description of the Related Art

A door holder must apply very high braking and holding forces which must be transmitted to the swivel bearing of the door-holding rod to the body of the motor vehicle. The high braking and holding forces result from the long lever arm between the door handle and the swivel bearing of a motor vehicle door and, on the one hand, from the increasing rate of motor vehicle doors due to the increased number of units mounted in the door and, on the other hand, from the speed of movement of the motor vehicle door during opening and closing.

A particular difficulty results from the fact that the locking means of the door-holding rod which interact with the braking and holding members in the holder housing have ramp-like stopping and starting tracks on both sides of a defined holding point for braking and holding the motor vehicle door with as little vibration as possible in the not fully opened holding position of the door and for limiting the resistance when the door is moved further into its permitted open end position. The ramp-like tracks ensure that the peak forces occurring during locking of the door in an opening position are reduced. However, when the braking or holding members move away from the ramp-like stopping and starting tracks, the direction of the forces acting in the door holder are suddenly reversed. This results in a quickly changing alternating load on the swivel bearing of the door-holding rod which, when even the smallest tolerances exist in the construction of the bearing, leads to highly undesirable clicking noises when the door is closed or opened. Since door holders for motor vehicle doors are always mass-produced articles and, thus, the manufacture must be relatively inexpensive, it is not possible to realize excessively narrow tolerances in the bearing of the door-holding rod.

In order to reduce the play in the swivel bearing of the door-holding rod as much as possible with inexpensive means, it has been suggested in German Offenlegungsschrift 19 15 751 to form the hinge pin supporting the door-holding rod as a tightening pin with a spring elasticity directed transversely of the bearing axis. However, this very effective measure cannot be utilized in all cases and requires special assembly units for assembling the door holder.

In another proposal for avoiding or reducing the bearing play in the swivel bearing of the door-holding rod, German Offenlegungsschrift 36 30 463 provides to hinge the door-holding rod by means of a rivet or a threaded bolt in a cantilevering manner to a one-arm bearing block and to arrange a spring load, particularly a plate spring, directed coaxially with the swivel bearing axis for removing the play in the swivel bearing. However, this proposal can also not be used in all cases and there is the danger that fatigue of the spring will load to an unsatisfactory operation of the swivel bearing.

It is, therefore, the primary object of the present invention to provide a swivel bearing for the door-holding rod of a door holder which can be manufactured simply and inexpensively and which is particularly not sensitive with respect to maintaining tolerances. In addition, it should be possible to either mount the door holder as a prefabricated component or as a set of components which can be assembled by means of mechanical assembly machines when the final assembly of the motor vehicle doors to the vehicle body takes place.

SUMMARY OF THE INVENTION

In accordance with the present invention, the hinge pin is of solid material and is rigidly but releasably connected to the end of the door-holding rod which is to be swivelably hinged. In addition, the hinge pin has axially extending portions which have a different diameter from the diameter of the middle axial portion of the hinge pin extending through the door-holding rod. The axial portions having the different diameter are in engagement with a running fit with two bearing openings of the bearing block which are arranged at a distance from each other.

The use of a releasable connection which is rigid in the assembled state of the hinge pin of solid material to the door-holding rod makes it possible to assemble the swivel bearing either when the door holder proper is manufactured or during the final assembly of the vehicle door. In the latter case, the number of components to be supplied individually can be reduced by providing initially only a preliminary connection of the hinge pin with the door holding rod.

Together with the use of a double-sided bearing block, the above-described construction and arrangement of the hinge pin provides the additional advantage that the bearing openings in the bearing block which receive the hinge pin have a relatively large axial distance from each other, so that any existing tolerances and unavoidable alignment errors with respect to the bearing play of the hinge pin are mutually compensated and the hinge pin is always and automatically supported without play in the bearing block even though the door holder is inexpensive and simple to manufacture and assemble. Alignment errors are not only those axial deviations occurring in the bearing block relative to the axial position of the bearing openings, but also particularly those which result from an assembled position of holder housing and bearing block in the vehicle door or vehicle body which is not exactly level or otherwise not in alignment.

There are several different possibilities for fastening the hinge pin to the door-holding rod. The preferred manner is by providing a screw thread on the middle axial portion of the hinge pin, the screw thread being constructed so as to be self-locking or even self-cutting, so that the hinge pin can be inserted into a simple bore of the door-holding rod.

The possibility of mounting the hinge pin at any time, even when the door holder is mounted in the vehicle body, is ensured by the fact that the hinge pin has over its entire length axial portions of different diameters, wherein the axial portions have starting from an end of the hinge pin successively a smaller diameter and the thread connecting the hinge pin to the door-holding rod is provided on the middle axial portion, while the remaining axial portions of the hinge pin are cylindrical with smooth surfaces.

For obtaining a self-acting and positive perpendicular alignment of the hinge pin relative to the longitudinal axis of the door-holding rod, particularly when the door-holding rod is made of a blank of flat material, a radially projecting shoulder is provided between the axial portion of the hinge pin having the greatest diameter and the axial portion of the hinge pin with the screw thread. When the shoulder is pressed against the surface of the door-holding rod, the alignment of the hinge pin is effected.

The hinge pin is received in the bearing openings of the bearing block so as to be rotatable about its axis and axially displaceable at least in one direction. As a result, any large deviations in the level position of the bearing block and the holder housing can be compensated. However, the axial displaceability of the hinge pin is limited in one direction by a radially projecting screw head attached to the axial portion of the hinge pin having the greatest diameter. The screw head may be a polygonal head, a socket head or a slotted head.

In accordance with the present invention, there are also several different possibilities for constructing the bearing block in which the hinge pin is received. In the simplest case, the bearing block is a U-shaped sheet metal blank. To increase the length of the bearing, the inner pistons between opposite surfaces of the sides of the bearing block with the bearing openings is a multiple of the thickness of the door-holding rod.

In accordance with another embodiment of the present invention, the bearing block supporting the hinge pin can also be constructed as a leaf-type hinge half made from blank of a hinge profile material. The portions of the hinge which face each other and define the hinge openings rest with little play against the side surfaces of the door-holding rod. For obtaining a sufficient bearing length, the two hinge openings have a greater axial length than the thickness of the door-holding rod. In particular, the axial length of the hinge openings may be twice or a multiple of the thickness of the door-holding rod.

This embodiment of the present invention makes it possible to support the hinge pin in the two hinge openings without requiring maintenance. The maintenance-free bearing is advantageously formed by collared sleeves of maintenance-free bearing material which are inserted in the hinge openings.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
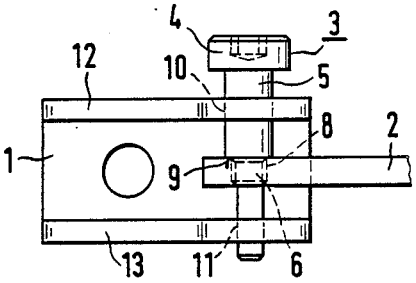
FIG. 1 is a top view of a simple embodiment of the swivel bearing for a door-holding rod.
Figure 2:
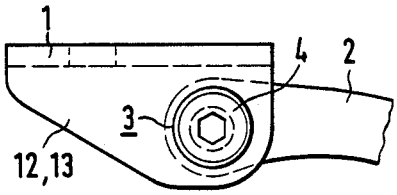
FIG. 2 is a side view of the embodiment of FIG. 1.
Figure 3:
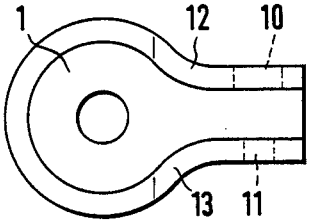
FIG. 3 is a top view of another embodiment of the bearing block of the swivel bearing.

In the embodiment of the present invention illustrated in FIGS. 1–3 of the drawing, a bearing block 1 of a swivel bearing for a door-holding rod 2 of a door holder, not completely illustrated in the drawing, is formed by a U-shaped profiled blank of sheet metal material. The door-holding rod 2 is also formed from a blank of sheet metal material. A hinge pin 3 which supports the door-holding rod 2 in the bearing block 1 is made of solid material and has, starting from a radially projecting screw head 4, successive axially extending portions 5, 6 and 7 with decreasing diameters. The middle axial portion 6 extending through the door-holding rod 2 is provided with a self-cutting external thread 8. The external thread 8 serves to connect the hinge pin 3 rigidly but releasably to the door-holding rod 2.

The axial portion 5 of the hinge pin 3 is provided with a radial shoulder 9 for positively and automatically perpendicularly aligning the hinge pin 3 relative to the longitudinal axis of the door-holding rod 2. When the hinge pin 3 is screwed into the door-holding rod 2, the surface of the shoulder 9 comes into contact with the surface of the door-holding rod.

The axial portions 5 and 7 of the hinge pin 3 are cylindrical and have smooth surfaces. The portions 5 and 7 are mounted with running fit so as to be rotatable and axially movable in at least one direction in hinge openings 10 and 11 of appropriate different diameters formed in the sides or flanges 12 and 13 of the bearing 1. The axial displaceability of the hinge pin 3 is limited by the screw head 4 which, in the illustrated example, is a socket head.

A comparison of the construction of the bearing block illustrated in FIGS. 1 and 3 shows that the bearing length of the swivel bearing of the door-holding rod can be adjusted in accordance with the existing requirements.

Figure 4:
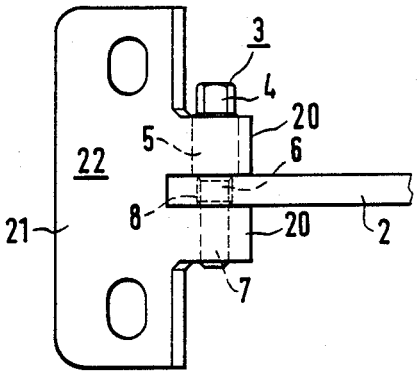
FIG. 4 is a top view of another embodiment of the swivel bearing of a door-holding rod.
Figure 5:
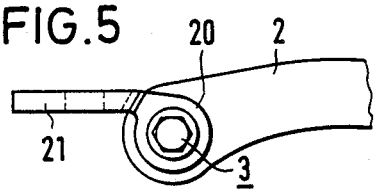
FIG. 5 is a side view of the swivel bearing of FIG. 4.

The embodiment of a swivel bearing for the holding rod 2 of a door holder shown in FIGS. 4 and 5 includes a bearing block 21 which is constructed as a leaf-type hinge half. The bearing block 21 has a hinge leaf 22 for fastening to a vehicle body component and two hinge openings 20 constructed as commercial parts. The end of the door-holding rod 2 is placed with little play between the hinge openings 20. However, for obtaining a sufficient bearing length of the screw bearing, the openings have an axial length which is several times greater than the thickness of the door-holding rod 2. In this embodiment, the hinge pin 3 has a polygonal screw head 4.

Figure 6:
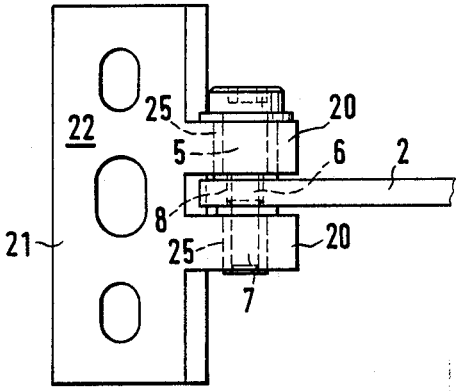
FIG. 6 is a top view of another embodiment of the swivel bearing for a door-holding rod.
Figure 7:
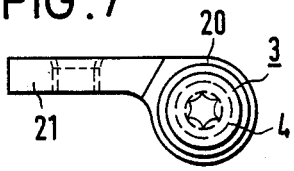
FIG. 7 is a side view of the swivel bearing of FIG. 6.

The embodiment of the swivel bearing of a door-holding rod 2 shown in FIGS. 6 and 7 differs from the one illustrated in FIGS. 5 and 6 initially in that the hinge pin 3 is mounted in the hinge openings 20 of the bearing block 1 in a maintenance-free manner by means of sleeves in the forms of collared sleeves 25. In addition, the screw head 4 of the hinge pin 3 is a cross-slotted screw head.

Figure 8:
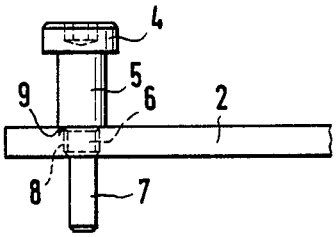
FIG. 8 is an illustration of a detail of a door-holding rod provided with a hinge pin.

Finally, as shown in FIG. 8, the door holder can also be supplied to the vehicle manufacturer in individual parts in order to be assembled during the final assembly of the vehicles. The hinge pin 3 is screwed only temporarily and not finally tightened in the door-holding rod in order to reduce the number of individually supplied parts.

Figure 8A:
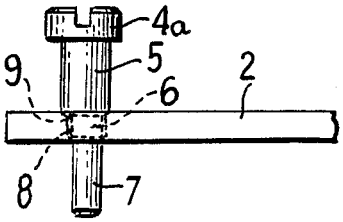
FIG. 8*a* is a view similar to FIG. 8, with a hinge pin having a slotted head.

FIG. 8*a* shows a hinge pin 3 having a slotted screw head 4*a*.

While a specific embodiment of the invention has been shown and described in detail to illustrate the application of the inventive principles, it will be understood that the invention may be embodied otherwise without departing from such principles.

I claim:

1. In a swivel bearing for a door-holding rod of a door holder of a motor vehicle, the door-holding rod having a first end supported in a bearing block mounted on a structural door component, a hinge pin connected to the bearing block, the door-holding rod being swivelable in a plane of a movement by means of the hinge pin about an axis extending parallel to the hinge axis of the motor vehicle door, the door-holding rod extending through a holder housing arranged on another structural door component, the holder housing including braking and holding members which are movable against a spring load perpendicularly to the plane of movement of the door-holding rod, the door-holding rod including at a second free end thereof a limit stop formed by a projection and locking slopes arranged adjacent the limit stop extending transversely of the plane of movement of the door-holding rod, the improvement comprising the hinge pin being of solid material, the hinge pin being rigidly but releasably connected to the first end of the door-holding rod, the hinge pin having an axially extending middle portion extending through the door-holding rod and axially extending portions which have a different diameter from the diameter of the middle portion of the hinge pin, the middle portion having a screw thread for fastening the hinge pin to the door-holding rod, the bearing block defining two bearing openings which are arranged at a distance from each other, the axial portions having the different diameter having different diameters from each other, being cylindrical with smooth surfaces, and being in engagement with a running fit in the two bearing openings of the bearing block.

2. The swivel bearing according to claim 1, wherein a radial shoulder defining a support and alignment surface for the perpendicular alignment of the hinge pin relative to the door-holding rod is formed on the axial portion having the greatest diameter.

3. The swivel bearing according to claim 1, wherein the bearing block is formed by a U-shaped profiled blank of sheet metal material.

4. The swivel bearing according to claim 3, wherein the U-shaped bearing block has flanges with sides facing each other, the bearing openings being provided in the flanges, the distance between the sides being a multiple of the thickness of the door-holding rod.

5. The swivel bearing according to claim 1, wherein the axial portion of the hinge pine having the greatest diameter has a free end, a radially projecting screw head being attached to the free end and being one of a polygonal head, a socket head and a slotted head.

6. The swivel bearing according to claim 5, wherein the screw head is a socket head.

7. The swivel bearing according to claim 5, wherein the screw head is a slotted head.

8. The swivel bearing according to claim 1, wherein the bearing block is a leaf-type hinge half formed from a portion of a hinge section, the hinge openings being defined in hinge portions which rest with little play against side surfaces of the door-holding rod, the hinge portions defining the openings having a greater axial length than the thickness of the door-holding rod.

9. The swivel bearing according to claim 8, comprising collared bushings of maintenance-free bearing material for lining the hinge openings of the bearing block.

* * * * *